US005625857A

United States Patent [19]

Shimada et al.

[11] Patent Number: 5,625,857

[45] Date of Patent: Apr. 29, 1997

[54] IMAGE FORMING APPARATUS WHICH MEASURES DEPOSIT AMOUNTS OF TONER

[75] Inventors: Akira Shimada; Toru Miyasaka; Nobuo Tokoro; Shin-ya Sato, all of Hitachi, Japan

[73] Assignee: Hitachi, Ltd., Tokyo, Japan

[21] Appl. No.: 369,216

[22] Filed: Jan. 5, 1995

[30] Foreign Application Priority Data

| | | | |
|---|---|---|---|
| Jan. 18, 1994 | [JP] | Japan | 6-003413 |
| Feb. 3, 1994 | [JP] | Japan | 6-011462 |
| Feb. 10, 1994 | [JP] | Japan | 6-016078 |

[51] Int. Cl.[6] ..... G03G 21/00

[52] U.S. Cl. ..... 399/49; 118/691

[58] Field of Search ..... 355/246, 208, 355/326 R, 327, 214, 210; 118/645, 688, 689, 690, 691; 250/559.07, 559.28

[56] References Cited

U.S. PATENT DOCUMENTS

| | | | |
|---|---|---|---|
| 4,279,498 | 7/1981 | Eda et al. | 118/691 |
| 4,313,671 | 2/1982 | Kuru | 118/688 X |
| 5,138,178 | 8/1992 | Wong et al. | 250/559.28 |
| 5,196,886 | 3/1993 | Nakane et al. | 355/246 |
| 5,200,783 | 4/1993 | Maeda et al. | 355/246 |
| 5,204,538 | 4/1993 | Genovese | 250/559.07 |
| 5,212,560 | 5/1993 | Hattori et al. | 355/208 X |
| 5,216,469 | 6/1993 | Yamada | 355/246 |
| 5,253,018 | 10/1993 | Takeuchi et al. | 355/246 |
| 5,270,784 | 12/1993 | Nakane et al. | 355/246 |
| 5,325,153 | 6/1994 | Mitsuse et al. | 355/326 R X |
| 5,357,317 | 10/1994 | Fukuchi et al. | 355/208 |

FOREIGN PATENT DOCUMENTS

| | | |
|---|---|---|
| 60-83057 | 5/1985 | Japan . |
| 61-209470 | 9/1986 | Japan . |
| 61-245177 | 10/1986 | Japan . |
| 62-280869 | 12/1987 | Japan . |
| 63-95471 | 4/1988 | Japan . |

*Primary Examiner*—Shuk Yin Lee
*Attorney, Agent, or Firm*—Kenyon & Kenyon

[57] ABSTRACT

In an image forming apparatus using an electrophotographic process, using a plurality of colors of toner including black toner, a reflectance of a base medium on which a toner image is formed is higher than that of black toner itself and lower than that of color toner. A toner deposit amount sensor provided in the image forming apparatus has a light-receiving element provided in the regular reflection direction from a toner image on the base medium. The light-receiving element has a wide light-receiving area so as to receive at least a part of irregularly reflected light besides regularly reflected light. The light-receiving element is then stored in a container for preventing the element from being contaminated by scattered toner, except the time of toner deposit amount measurement. Measurement characteristics of the toner amount sensor are corrected when being stored in the container by using a correction plate provided in the container. Furthermore, the deposit amount of each color of toner is controlled by relations between image forming control parameters and the deposit amount of each color of toner is controlled by relations between image forming control parameters and the deposit amount of each one of the plurality of colors of toner and black toner, the relations being memorized in advance.

19 Claims, 9 Drawing Sheets

IMAGE FORMING APPARATUS WHICH MEASURES DEPOSIT AMOUNTS OF TONER

BACKGROUND OF THE INVENTION

The present invention relates to an image forming apparatus using such electro-photographic process as laser printing, image copying etc., particularly to an image forming apparatus using plural colors of toner.

The electro-photographic process executes process of electrifying a photosensitive medium, exposing an image on the medium and developing the exposed image for each color of an image and superimposes images of respective color the exposed image. In the electro-photographic process, a multi-color image is usually formed by repeating a single color photographic process.

In Japanese Patent Application Laid-Open No. 95471/1988, in order to keep the concentration of each color image constant, it is presented that the reflectance of an image developed on an image formed on an image forming base medium is measured and fed back to image forming control conditions. Then, the accurate and stable measurement of toner deposit amounts is important for the above-mentioned method in which each color toner deposit amount is measured and the image forming control conditions are adjusted based on the measured toner deposit amounts. Since color toner of yellow toner, magenta toner and cyanine blue toner used for forming a color image absorbs a part of light wave band peculiar to each color, a decrease ratio of light reflected from the color toner due to increase of the toner deposit amount is smaller than that of black toner. Therefore, it is generally considered that the accurate measurement of color toner deposit amounts is difficult. A method of accurately measuring the deposit amounts of color toner and black toner is described in Japanese Patent Application Laid-Open 280869/1987. In FIG. 15, a relation between output changes of a photo-sensor and toner deposit amount changes, measured by a photo-sensor arranged at a position for measuring regular reflection as shown in FIG. 14, is shown. From FIG. 15, it is apparent that the output changes of the photo-sensor to the deposit amounts of color toner are smaller than those of black color. And, in the above-mentioned patent application, it is shown that such results as shown by FIG. 17 are obtained by measuring light reflection with a photo-sensor arranged as shown in FIG. 16, for receiving irregularly reflected light. Then, in the application, it is devised that a photo-sensor arranged at the position as shown in FIG. 14 is used for measurement to black toner, and a photo-sensor as shown in FIG. 14 is used for measurement to color toner. In Japanese Patent Application Laid-Open 245177/1986, in order to measure the toner deposit amount more accurately, it is disclosed that a standard high concentration image forming part and a standard low concentration image forming part are provided on a part of a photosensitive medium, respectively, the measurement being carried out by forming a color image on the former part and a black image of the latter part.

In the above-mentioned conventional technique of measuring increase of irregular reflection components due to increase of the toner deposit amount, the technique has several problems in measuring color toner deposit amounts. The results by the technique is easily affected by toner depositing manners or surface states of deposited toner, and the measured values are likely to be uncertain since the technique measures the irregular reflection. The conventional techniques measure a small part of the whole light reflected from deposited toner, which makes the measured values uncertain.

The conventional technique discussed above measures the toner deposit amount by using a reflection mode transition of light from the regular reflection to the irregular reflection. The reflection mode transition also occurs in a reflection from black toner. In the conventional techniques, a photo-sensor for measuring the toner deposit amount is arranged at the position receiving the regular reflection. Light amount received by a photo-sensor rapidly decreases corresponding to increase of the toner deposit amount since the reflection mode transits from the regular reflection to the irregular reflection. The toner deposit amount for gaining a sufficient concentration of an image is about 1 mg/cm$^2$. However, light amount received by a photo-sensor is very small at the toner deposit amount 1 mg/cm$^2$ as shown in FIG. 15 in the measurement of black toner. Then, Accuracy and certainty of the measurement of black toner is also not sufficient.

In case an intermediate transfer medium is used, a toner concentration of a transfered image greatly changes due to such a change as environment variation of the intermediate transfer medium. So it is effective to measure the toner deposit amount of an image formed on the intermediate transfer medium.

The above-mentioned conventional technique adopting two photo-sensors for measuring black toner and color toner makes a composition of the sensors, sensor corrections and a measurement control method, of a toner deposit amount measuring device complicated.

Another toner deposit amount measuring device for measuring the toner deposit amount on a developing roll is disclosed in Japanese Patent Application laid-Open No. 83057/1985. A toner deposit amount sensor of the measuring device is arranged opposite to the developing roll during toner deposit amount measurement and moved by rotation to a position not opposite to the developing roll, being cleaned and corrected with a cleaning device and a correction member in the rotating motion so as not to be contaminated by toner. However, the above-mentioned toner deposit amount measuring device does not have a means for containing and sealing up the toner deposit amount sensor, and the toner deposit amount sensor is likely to be contaminated by scattered toner particles, which causes decrease of effective light amount emitted from a light-emitting element of the sensor and degrades receiving of light reflected by a pattern image for measuring the toner deposit amount. Furthermore, the measuring device does not have such a composition as prevents effects by the light from the outside and the scattered toner particles from depositing on the correcting member. Then, it is difficult accurately to measure a reflectance of a toner image during long period by the above-mentioned measured device.

SUMMARY OF THE INVENTION

The present invention has been achieved in consideration of the above-described problems, and relates to a multi-color image forming apparatus capable of keeping images of high quality by certainly and accurately measuring deposit amounts of color toner and black toner.

To attain the above-mentioned advantages, the present invention devises a toner deposit base medium on which toner images are formed (refereed to a base medium), having a reflectance of the base medium at the position where color toner deposit amounts are measured, lower than that of color toner itself. And a reflectance of the base medium at the position where a black toner deposit amount is measured is larger than that of black toner itself. In case the toner deposit amounts are measured by the same toner deposit amount sensor or at the same position of the base medium, the reflectance of the base medium at the measurement position is made smaller than color toner itself and larger than black toner itself. Further, a light-receiving element of the sensor is made so as to receive a wider range of reflected light besides regularly reflected light. Further, the surface of the base medium at the toner deposit measuring position is processed so as to have such roughness on the surface under no toner deposit condition that the roughness makes nearly the same light scattering state as the scattering state on the surface under toner deposit condition.

Further, it is also devised that the strength of light emitted from a photo-emitting element of the sensor is made stronger in measuring the black toner deposit amount than in measuring the color toner deposit amounts.

Furthermore, in a development device for each of black toner and color toner, a relation between toner deposit amounts and toner deposit control parameters of an image forming process for each color is commonly used or correlations among the toner deposit control parameters for all colors of toner including black toner are stored in a control means for controlling the development devices in advance, to form a toner image of each color or black.

By the above-mentioned means of the present invention, it is possible to measure certainly and accurately deposit amount changes of color toner having high reflectance since a reflectance of the base medium at the position where color toner deposit amounts are measured is lower than that of color toner itself.

And almost the whole light reflected from deposited toner can be detected by the measurement means of the present invention, different from a light reflection measurement based on the reflection mode transition from the regular reflection to the irregular reflection, since the light-receiving element of the sensor is made so as to receive a wider range of reflected light besides regularly reflected light.

And it is possible to control certainly and accurately the toner deposit amounts without decreasing light amount received by the light-receiving element of the toner deposit amount measuring device even in measuring the black toner deposit amount since the strength of light emitted from the photo-emitting element is made stronger in measuring the black toner deposit amount than in measuring the color toner deposit amounts.

And the toner deposit control parameters for all colors of toner including black toner can be controlled even if the measurement for some color toner is difficult, since deposit amount of non-measured toner can be estimated by using the correlations among the toner deposit control parameters for color toner and black toner stored in advance.

In another embodiment for attaining the above-mentioned objects, a toner deposit amount measuring device comprises a container for storing a toner deposit amount sensor, a shift means for moving the toner deposit amount sensor from a sensor containing position in the container to a measurement position at which the sensor is arranged opposite to the base medium and a correction member is provided in the container and used for correcting the sensor in the container.

By the above-mentioned means, it is possible to prevent contamination of the toner deposit amount sensor by toner particles and to measure the toner deposit amount of an image formed on the base medium accurately in a long period since the sensor is moved and stored in the container except the time when the sensor measures the toner deposit amount of an image formed on the base medium. Further, it is possible to correct measurement characteristics of the sensor and to compensate a change with the passage of time and a change with temperature change of the sensor precisely since the correction is carried out by using a correction member keeping always constant reflection characteristics without using the base medium of which reflection characteristics changes with the passage of time or environmental temperature changes.

DETAILED DESCRIPTION

Hereinafter, details of the present invention is explained based on embodiments referring to drawings.

Figure 1:
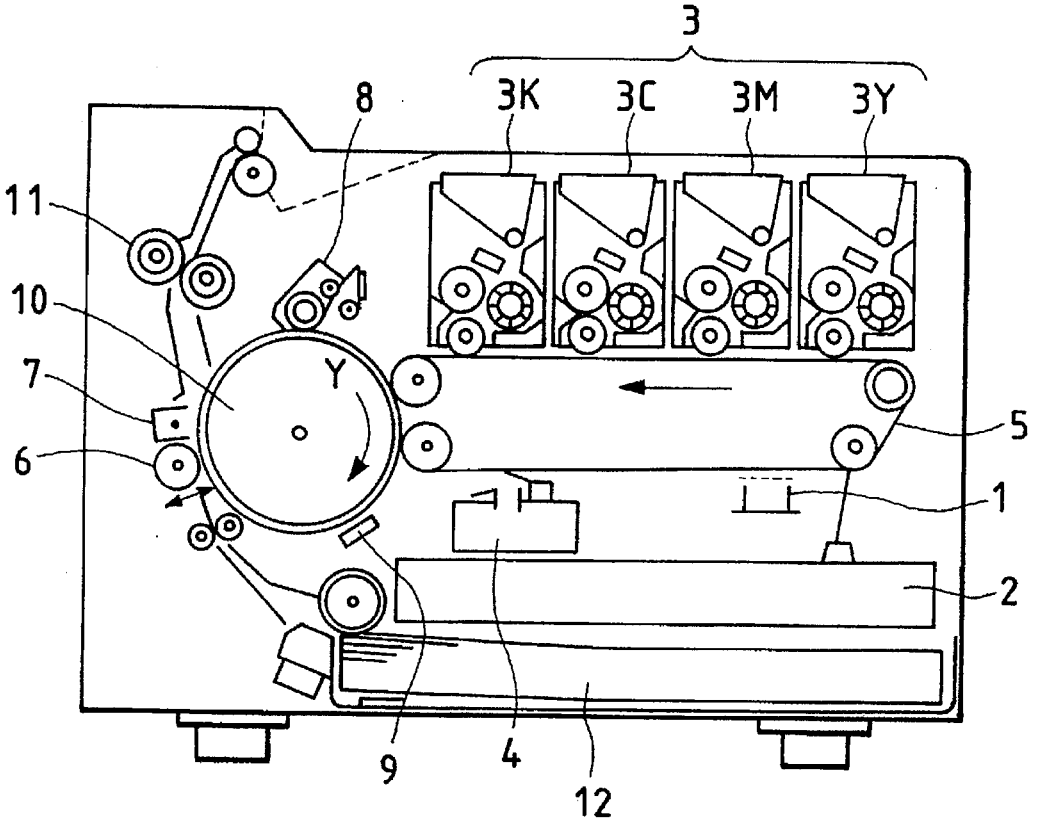
FIG. 1 shows a constitution of an embodiment of an image forming apparatus by the present invention.

FIG. 1 shows an embodiment of an image forming apparatus having a toner deposit amount measuring device by the present invention. The image forming apparatus shown by FIG. 1 comprises a belt photosensitive medium 5 of the first toner deposit base medium (referred to a base medium), around which a charger 1, a semiconductor laser exposure device 2, four development devices 3 (3Y, 3M, 3C and 3K) for four colors of yellow, magenta, cyanine blue and black, and a cleaner 4 are arranged, an intermediate transfer drum 10 of the second base medium, around which a transfer device 6 for transferring toner images from the drum to a paper sheet or other media, a discharge device 7, another cleaner 8 and a toner deposit amount measuring device 9 (referred to a toner measuring device) are arranged, and an image fixing device 11. Firstly, operations of the apparatus of the present embodiment are explained in ordinary full color image forming, in the following. After the belt photosensitive medium 5 is electrified to a definite voltage by the charger 1 and exposed according to yellow image signals by the exposure device 2, the yellow image exposed on the belt photosensitive medium 5 is developed and formed as a visible image by the yellow development device 3Y. The visualized yellow image is electrostatically transfered on the transfer drum 10. In succession, after the belt photosensitive medium 5 is cleaned, an electrostatic latent image of magenta is again formed on the photosensitive medium 5 by electrifying and exposing process, and developed by the magenta development device 3M. The developed magenta image is superimposed on the yellow image upon the transfer drum 10. Similarly, a cyanine blue image and a black image are formed, and the yellow, the magenta, the cyanine blue and the black toner images are superimposed, and the full color image is finally made up on the transfer drum 10. The full color image formed on the transfer drum 10 is electrostatically transfered on a paper sheet conveyed from a paper sheet tray 12 by the transfer device 6, and discharged by the discharge device 7. The discharged image on the paper sheet is shifted to the image fixing device 11, and heated and fixed on the paper sheet to finish the forming process of the full color image.

In such an image forming apparatus as the present embodiment, a full color image is formed by superimposing the four color images of yellow, magenta, cyanine blue and black. Then, in order to form an image of high quality, it is important to balance the toner concentrations (described also as deposit amount) of images of four colors adequately and certainly. For realizing the adequate toner concentration of each color image, the toner measuring device 9 is provided near the transfer drum 10 and a means for controlling the image forming process based on the measured toner deposit amount is also prepared in the embodiment. Further, the embodiment possesses an ordinary printing mode for forming an ordinary full color image and a test mode for adjusting image forming control parameters to balance the toner concentration of an image of each color.

In the embodiment, the test mode is executed to set the image forming control parameters to adequate values in advance of the ordinary printing mode. Although process of the test mode is almost the same as that of the ordinary printing mode, an image formed on the transfer drum 10 is not transfered on a paper sheet and erased by the cleaner 8. As the image forming control parameters affecting the toner deposit amount, exposure strength, a charge amount of toner, a bias voltage for development, transfer conditions, etc. can be used, and the bias voltage for development, being easily changed and affecting the toner deposit amount notably, is used as the image forming control parameter in the embodiment. Since such troubles as toner deposit on parts of a paper sheet to be left white occur due to decrease of a potential difference between a potential of the charging part the belt photosensitive medium and the bias voltage for development, a charging voltage by the charger 1 is also controlled in the embodiment. The toner deposit amount measurement needs to be carried out for each color toner since the toner deposit amount control is necessary to each color toner. The image forming control parameter (the bias voltage in the present embodiment) is adjusted so that the deposit amount of each color toner accords with the preset value on the basis of the measurement results. After the adjustment of the image forming control parameter for each color toner, process of the apparatus turns to the ordinary printing mode in which a full color image formed in accordance with information of an image to be formed is printed on a paper sheet. Since the toner deposit amounts change with environmental condition variations or aging changes of an image forming apparatus, the test mode is automatically executed and the toner deposit amount is re-adjusted, after printing the preset number of printed paper sheets or after the preset passage of time.

Figure 2:
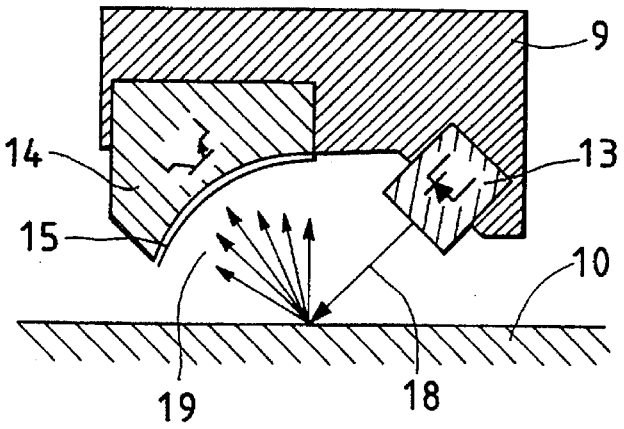
FIG. 2 is a drawing for explaining a detailed structure of a toner deposit amount measuring device by the present invention.

FIG. 2 shows a detailed structure of the toner deposit amount device installed in the apparatus of the embodiment shown in FIG. 1. A sensor part of the toner measurement device has a light-emitting element 13 and a light-receiving element 14, the light-emitting element 13 irradiating light on the deposited toner, and the light-receiving element 14 detecting the light reflected from the deposited toner and outputting a voltage signal proportional to the detected light amount. A light-emitting diode, a semiconductor laser, etc. are used as the light-emitting element, and a phototransistor and so on as the light-receiving element. The light amount detected by the light-receiving element changes by such a reflection mode change as a mode transition from a regular reflection to a irregular reflection. A light-receiving element having a larger light receiving area can measure the toner deposit amount more certainly since such a light-receiving element is less affected by the reflection mode change. A light receiving area and arrangement of the light-receiving element in the sensor part of the embodiment are designed so that the light-receiving element can receive the reflected light of wide range 19 including the regularly reflected component of the light emitted from the light-emitting element 18. Further, the surface part of the transfer drum, on which the toner deposit amount is measured, has such roughness that mirror reflection does not occur at the surface part, in order to reduce the effects of the reflection mode change and improve measurement accuracy.

Furthermore, in the embodiment, an element for infrared ray, not including the light of wave band absorbed by color toner, is used for at least one of the light-emitting element 13 and the light-receiving element 14, which reduces effects by the differences of sensor measurement characteristics caused by differences of toner colors. A similar merit can be gained by providing an infrared ray transmitting filter 15 on the light-receiving element.

Figure 3:
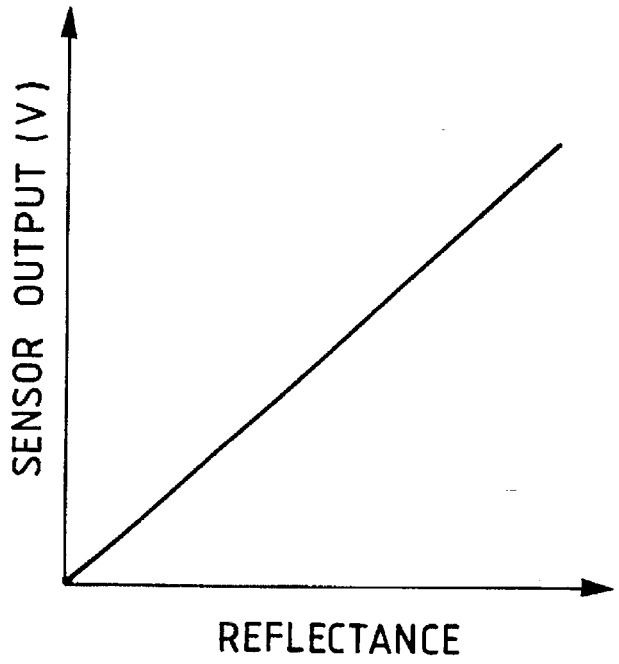
FIG. 3 shows measurement results of a relation between reflectance of the measured toner and sensor outputs.

FIG. 3 shows measurement results of a relation between reflectance of the measured toner and outputs of the sensor part shown by FIG. 2. The measured reflectance and the outputs of the sensor part are in proportion.

Figure 4:
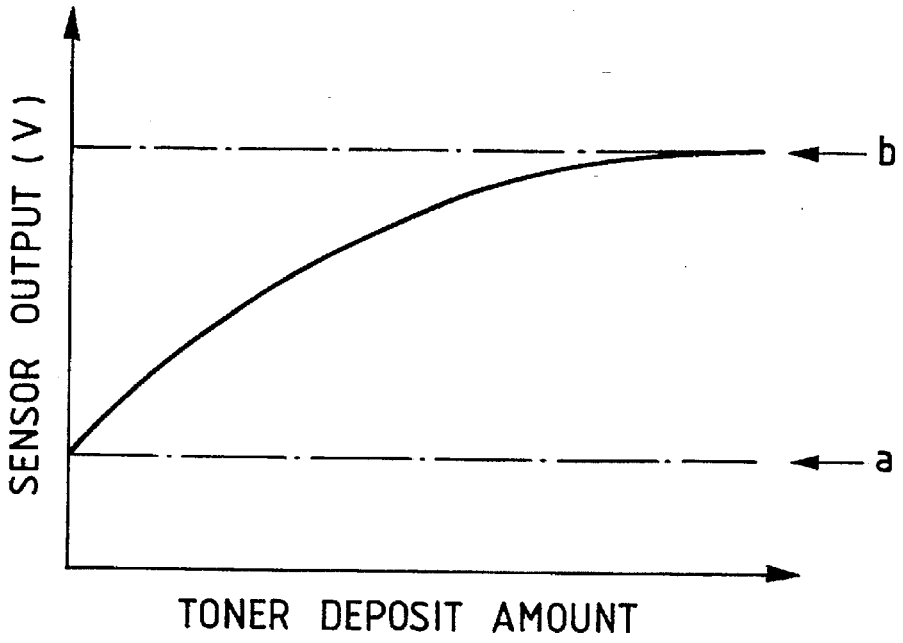
FIG. 4 is a graph typically showing sensor output changes in accordance with changes of a toner deposit amount on an intermediate transfer drum.

FIG. 4 is a graph typically showing output changes of the sensor part in accordance with changes of the toner deposit amount on the transfer drum. The level of line [a] shown in the figure indicates an output of the sensor part in measuring a reflectance of the base medium surface, and the level of line [b] indicates a measured reflectance of toner itself. The output of the sensor part increases from the level of line [a] to the level of line [b] according to increase of the toner amount deposited on the transfer drum, as shown by FIG. 4. Therefore, the more the difference between the reflectance of the drum surface and that of toner itself increases, the more the accuracy of toner deposit amount measurement increases. Since the absorption of color toner of light in the band except the specific wave band is low and the light amount reflected by color toner is large, then the reflectance of color toner is high. On the other hand, since the absorption of black toner is high in the whole wave band and the light amount reflected by black toner is small, then the reflectance of color toner is low. Then, in the embodiment, the reflectance of the surface part of the transfer drum on which the deposit amount of color toner is measured is made low, and that of the surface part on which the deposit amount of black toner is made high.

Figure 5:
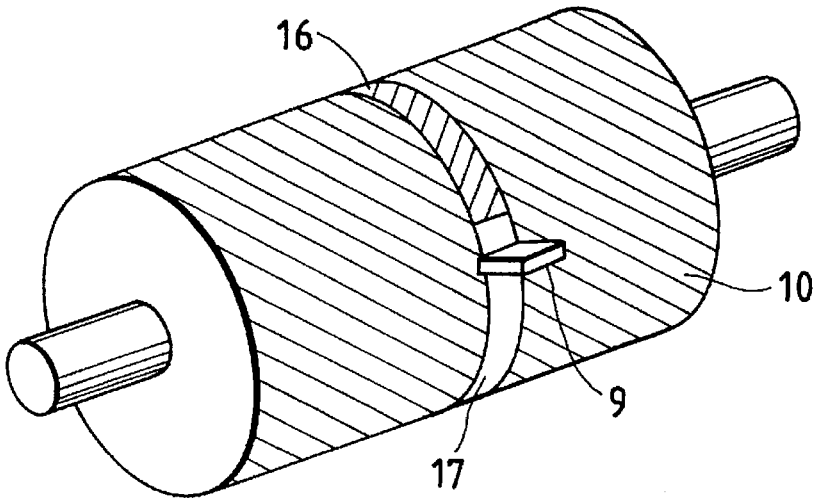
FIG. 5 is a perspective view of an intermediate transfer drum of an embodiment by the present invention.

In FIG. 5, a perspective view of the transfer drum 10 of the embodiment is shown. In the transfer drum 10, reflectance of two surface parts on which each of color toner deposit amounts and black toner deposit amount is measured are changed each 180 degrees in the rotation direction of the drum. An image forming position is so controlled in the test mode that on the surface part 16 having a low reflectance, the deposit amount of color toner having a high reflection is measured, and on the surface part 17 having a high reflectance, the deposit amount of black toner having a low reflectance is measured.

Figure 6:
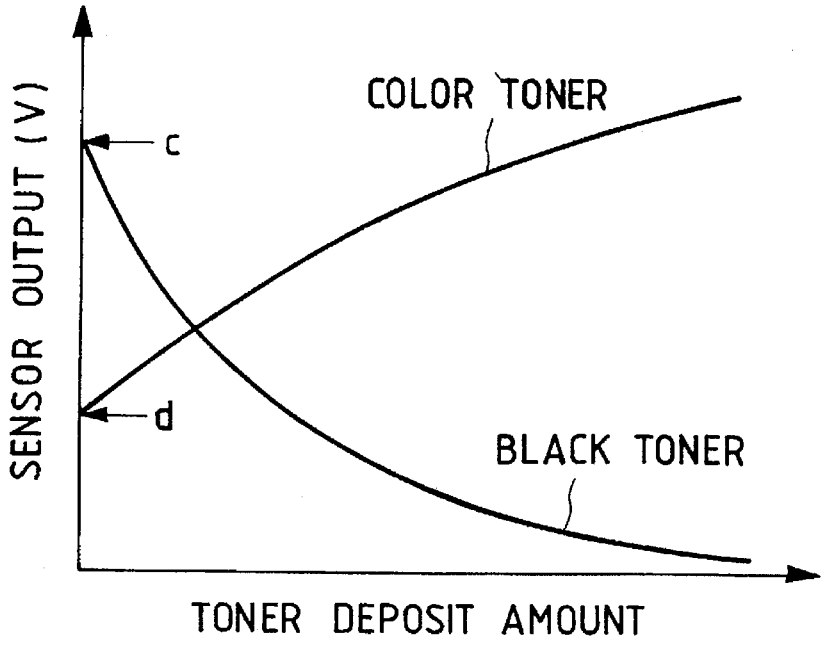
FIG. 6 is a graph showing a relation between sensor outputs and toner deposit amounts in an embodiment.
Figure 7:
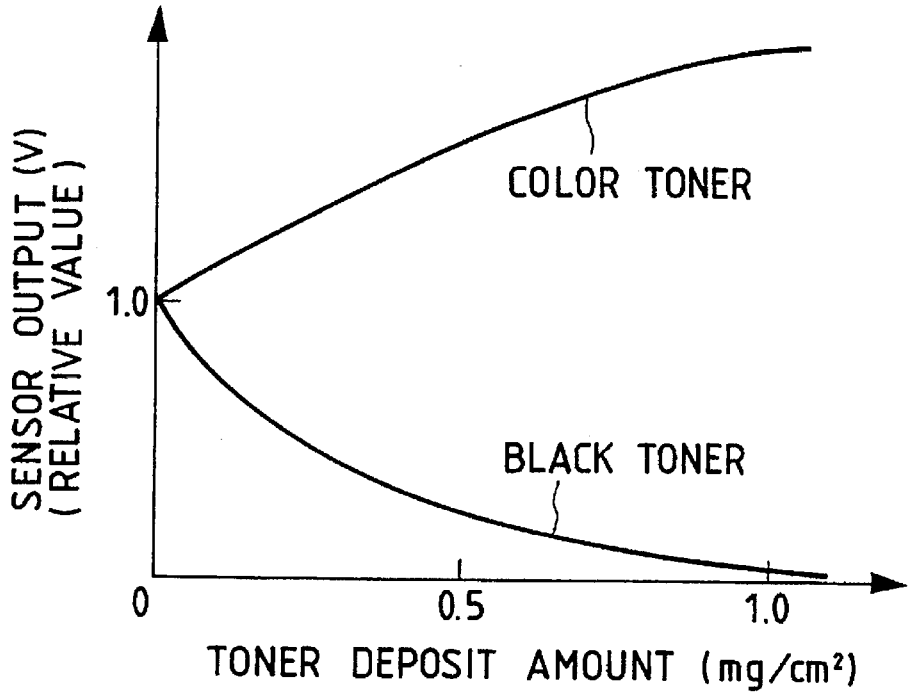
FIG. 7 is a graph showing sensor output changes in accordance with changes of the color toner deposit amount and the black toner deposit amount in case of the constant transfer drum reflectance.

FIG. 6 is a graph showing a relation between the sensor outputs and the toner deposit amount in the embodiment. The sensor outputs as to color toner are measurement results on the surface part having a low reflectance, and those as to black toner are measurement results on the surface part having a high reflectance. The value [c] in the figure is the sensor output to the reflectance of the base medium surface part on which the deposit amount of black toner is measured, and the value [d] is the sensor output to the reflectance of the base medium surface part on which the deposit amount of color toner is measured. Although the measuring position for color toner having a high reflectance is different from that for black toner having a low reflectance in the present embodiment, it is possible to design the reflectance of the base medium surface part on which the measurement is executed so that the reflectance of the base medium surface part is lower than the reflectance of color toner and higher than that of black toner. FIG. 7 is a graph showing sensor output changes in accordance with changes of the color toner deposit amount and the black toner deposit amount in case the reflectance of the measuring position for the both of color toner and black toner are the same. If the enough difference between the reflectance of the base medium surface and that of black toner can not be realized, it is also effective to set the strength of emitted light stronger in measuring the black toner deposit amount than in measuring the color toner deposit amounts, for improving the measurement accuracy of the black toner deposit amount.

Figure 8:
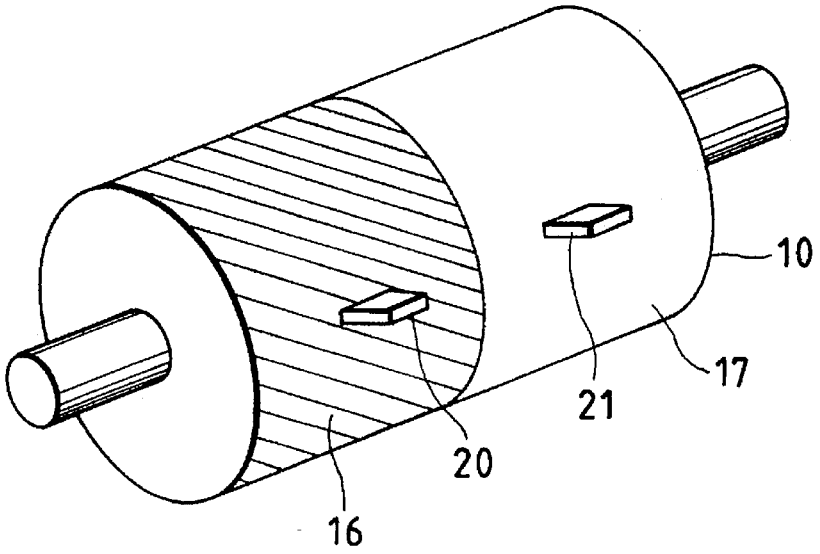
FIG. 8 is a perspective view of an intermediate transfer drum of another embodiment by the present invention.

Although one sensor part is used for the toner deposit amount measurement in the above-mentioned embodiment, it is also useful to divide the measuring surface region into two regions in the direction of the drum axis, each region having a reflectance different from each other, to two sensor parts for color toner and black toner, as shown by FIG. 8.

Furthermore, it is also effective to measure the color toner deposit amount on the drum by reducing the reflectance of the transfer drum surface, and to measure the black toner deposit amount on the photosensitive medium, since a generally used organic photosensitive medium has a high surface reflectance. However, the measurement accuracy on the surface of the organic photosensitive medium is likely to be lower than that on the drum since the above-mentioned reflection mode transition occurs due to almost mirror reflection on the surface of the photosensitive medium. In case the transfer drum is not provided in the image forming apparatus, the toner deposit amount should be measured on the photosensitive medium. In such constitution of the apparatus, the following methods may be used, that is, a method of coloring the photosensitive medium by applying conductive colored material on the surface of the photosensitive medium, or a method of mingling coloring material into the resin composing the photosensitive medium so as to have an adequate reflectance. However, use of those methods are not preferable since the methods probably cause photosensitivity decrease of the photosensitive medium. Therefore, it is preferable to measure the color toner deposit amount on the transfer drum receiving no effects of coloring, which makes it possible the measurement of the toner deposit amounts containing effects of environment change in transfer.

By the image forming apparatus of the above-mentioned embodiment, it is possible accurately to measure both of the deposit amount of color toner generally having a high reflectance and that of black toner generally having a low reflectance since the reflectance of the surface part at the measuring position on the base medium is made larger in case the measured toner has a small reflectance, and vice versa. Furthermore, the accurate measurement of toner deposit amount is possible by providing a sensor part having a wide light-receiving area in the direction of regular reflection from the position on the base medium at which the toner deposit amount is measured, the sensor part being able to receive also at least a part of light irregularly reflected from the deposited toner.

In the following, another embodiment is explained. Optical measurement of black toner deposit amount is difficult since black toner largely absorbs light, and the reflected light amount from black toner is very small even though the deposit amount of black toner is very little, as shown by FIG. 7. On the other hand, outputs of a sensor part detecting the reflected light from color toner increase in accordance with increase of toner deposit amount since the reflectance of color toner is larger than that of the transfer drum 10 of the base medium. Since the outputs of a sensor part is almost proportional to the color toner deposit amounts at the region of 0.8–1.0 mg/cm$^2$ where an adequate image concentration can be gained, the deposit amount can be accurately measured in the case of color toner. As to black toner, optical measurement of black toner deposit amount is difficult as already mentioned, and then the deposit amount of black toner is hardly controlled on the basis of deposit amount measurement by using a test pattern. Therefore, it is considered effective to adjust image forming control parameters for black toner based on those for color toner since concentration changes of a black image are not sensitive to changes of the black toner deposit amount. As one of methods realizing the above-mentioned control of black toner, it is devised in the embodiment that the whole image forming control parameters of all colors of toner, including black toner are decided from the measured deposit amount of at least one color of toner, by designing the development device for each color so that the relations between the image forming control parameters and the toner deposit amount for each color are common to all colors of toner, since the change amount of toner depositing characteristic due to the change of an environment condition is almost the same to all color toner. And, it is also devised in the embodiment that, by memorizing the functions of representing correlations among the image forming control parameters for each color toner in advance, the optimal image forming control parameters for the colors of toner whose deposit amounts are not measured, are obtained from those for the colors of toner whose deposit amounts are measured, by using the functions. The former method is difficult to design but the control using the method is easy. The latter method is easy to design but the control using the method is complicated. In the following, a toner deposit amount control using the latter method is explained.

Figure 9:
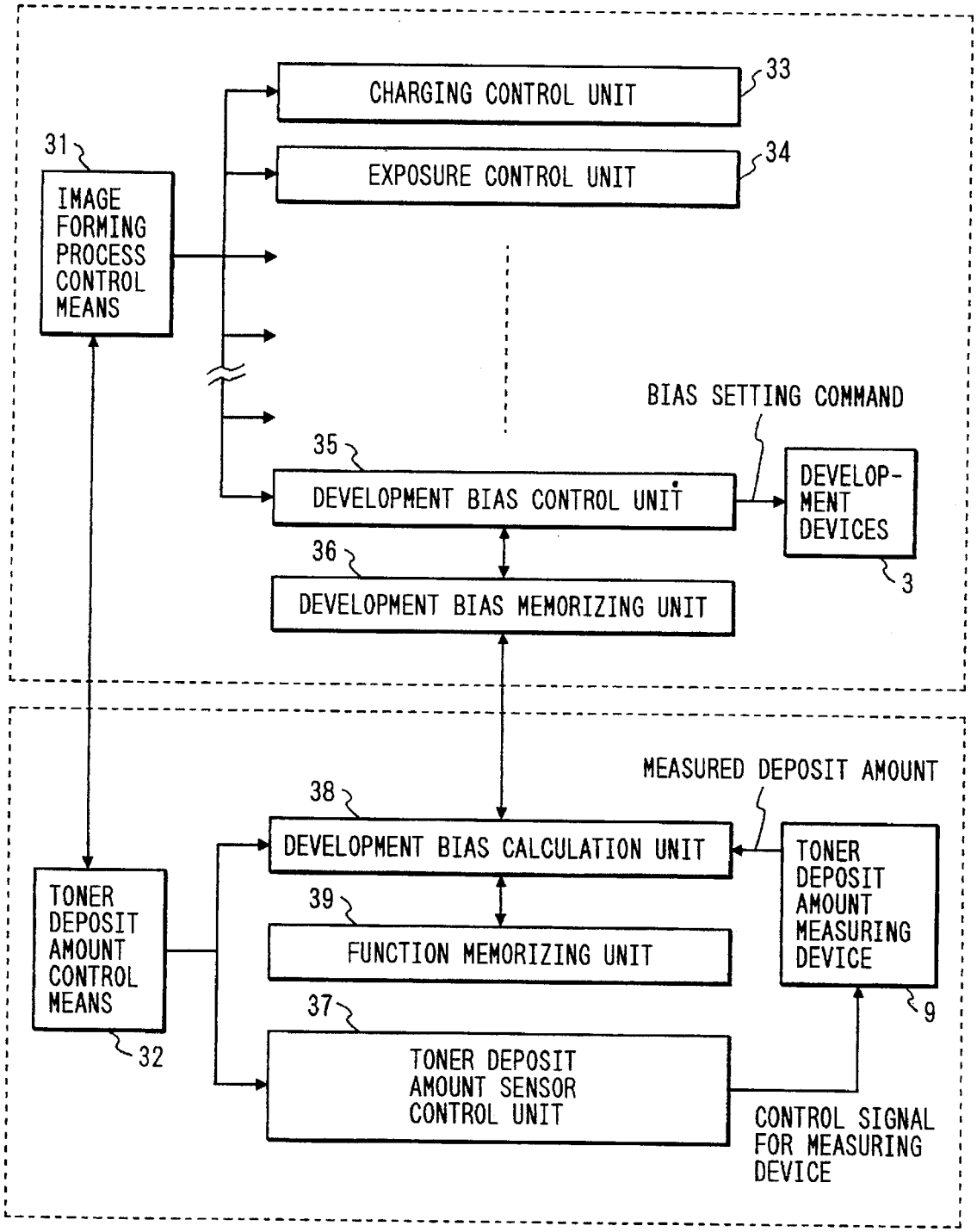
FIG. 9 is a block diagram showing a structure of a control means for controlling toner deposit amounts of an embodiment.

FIG. 9 is a block diagram showing a composition of a control means for controlling toner deposit amounts, by using the above-mentioned latter method. The control means is divided into two means of an image forming process control means 31 and a toner deposit amount control means 32. The image forming process control means 31 comprises many control means affecting the toner deposit amounts, such as a charging control unit 33, an exposure control unit 34 and so on. In the embodiment, the toner deposit amount control is carried out by controlling the bias voltages of development in the development devices 3 by using a development bias control unit 35. The toner deposit amount control means 32 comprises a toner deposit amount sensor control unit 37 for controlling the sensor part of the toner deposit amount measuring device 9 and a development bias calculation unit 38 for obtaining the optimal development biases. The development bias calculation unit 38 determines the optimal development biases by using the functions stored in the mentioned-later function memorizing unit 39, and the determined development biases are stored in a development bias memorizing unit 36 and used in the printing mode. The optimal bias voltages for yellow toner, magenta toner, cyanine blue toner and black toner is marked as YB, MB, CB and KB. Correlations exist among these biases, and the correlations as to the bias of black toner are expressed by the following functions.

$$KB=f1(YB)=f2(MB)=f3(CB) \quad (1)$$

In the embodiment, linear functions as expressed in the form KB=a×YB (a: a constant) are used as the above-mentioned functions of representing the correlations among the optimal development biases for each color toner, which are stored in the function memorizing unit 39. Then, the optimal development biases for other colors of toner whose deposit amounts are not measured are obtained as the functions of the optimal biases for the colors whose deposit amounts are measured. Therefore, as to such the toner as black toner whose deposit amount is hardly measured, the deposit amount of the toner can be optimally controlled based on the optical development biases of color toner whose deposit amounts are more easily measured. Further, as for color toner also, the time required for the test mode can be reduced by decreasing the color number of toner to be measured since the development biases for the other colors of toner whose deposit amounts are not measured can be set without directly measuring their deposit amounts if only the deposit amount of at least one color of toner is measured. In the present embodiment, a precise test mode A and a rough test mode B are provided. In the precise test mode A, all deposit amounts of test patterns for yellow toner, magenta toner and cyanine blue toner are measured and the optimal development bias for each color is set at the start of the image forming apparatus or after the predetermined number of paper sheets are printed. And, in the rough test mode B, only the deposit amount of one color of toner is measured between the tests of the mode A, and the optimal development bias for the toner is set. Then, the optimal development biases for the other colors of toner as well as the optimal development bias for black color are estimated on the basis of the already obtained development bias of the toner by using the functions. By the embodiment, the interruption frequency of the printing mode can be minimized by executing accurate control of the development biases in the test mode A at low frequency, and executing simple and quick control of the development biases of the test mode B at high frequency. And, the combination of the colors whose toner deposit amounts are estimated and the other colors whose toner deposit amounts are measured can be unrestrictedly determined, by combining the above-mentioned functions.

As explained above, by using the conditions that the relations between the image forming control parameters and the toner deposit amounts for each toner are the same for all the used color, or the memorized functions of representing correlations among the image forming control parameters for all the used colors of toner, it is possible to estimate the optimal image forming control parameters for the other colors whose toner deposit amounts are not measured based on those for the colors whose toner deposit amounts are measured, by using the functions. Then, the deposit amounts of the toner hardly to be measured can be accurately controlled by the image forming control parameter estimated as the functions of the control parameters for the colors whose toner deposit amounts can be more easily measured.

Figure 10:
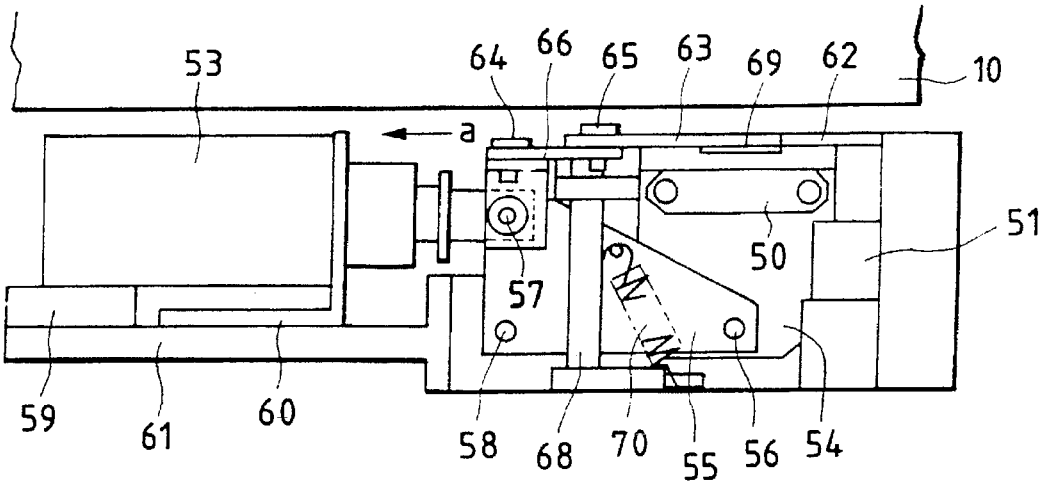
FIG. 10 is a side cross sectional view of a toner deposit amount measuring device of another embodiment by the present invention.
Figure 11:
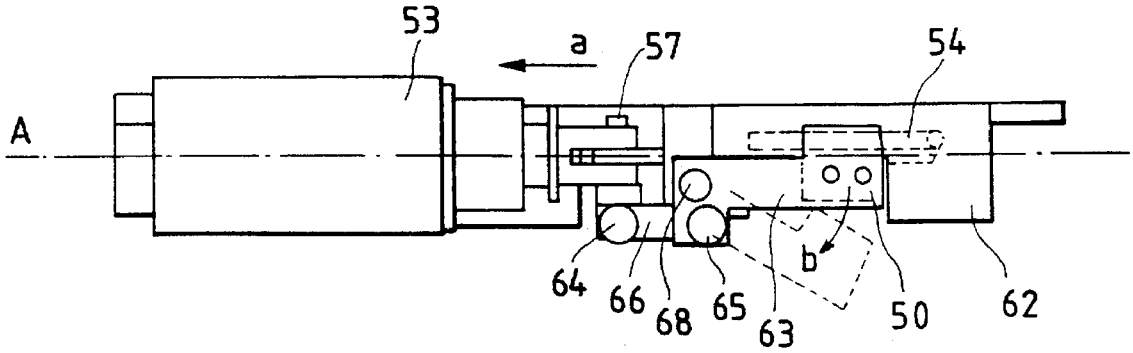
FIG. 11 is a top plan view of the toner deposit amount measuring device shown by FIG. 10.
Figure 12:
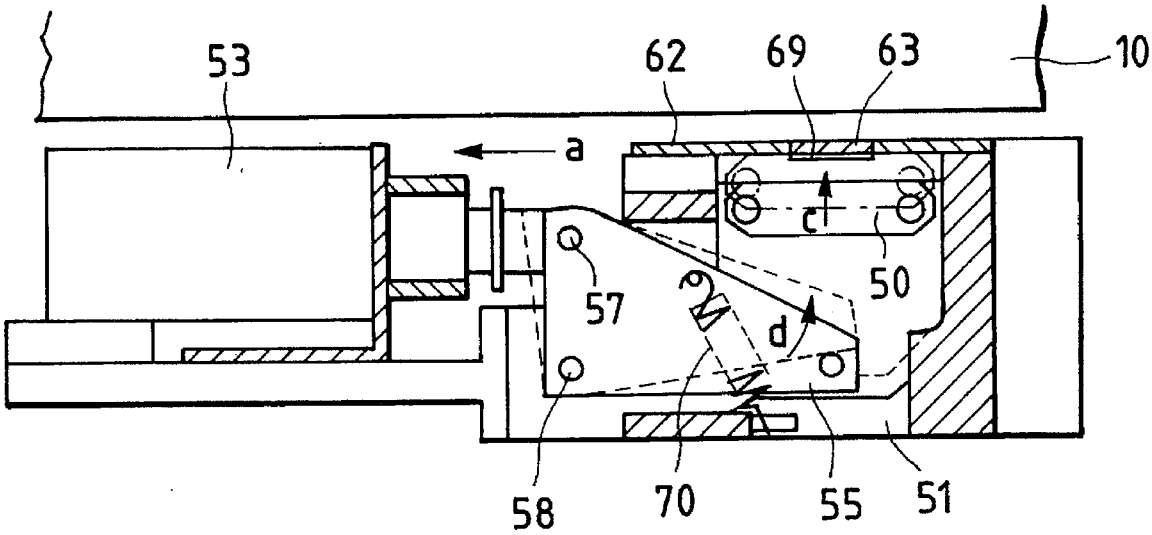
FIG. 12 is a cross sectional view taken along line A of FIG. 11.

In the following, a structure and operations of a toner deposit amount measuring device 9 in another embodiment are explained. FIG. 10 is a side cross sectional view of the toner deposit amount measuring device 9 and FIG. 11 is a top plan view of the toner deposit amount measuring device 9 shown by FIG. 10. And FIG. 12 is a cross sectional view taken along line A of FIG. 11. The toner deposit amount measuring device 9 is mainly composed of a toner deposit amount sensor 50, a container 51 storing in the toner deposit amount sensor 50 and a solenoid 53 for shifting the toner deposit amount sensor 50 between a measurement position and a containment position. The toner deposit amount sensor 50 has a LED and a phototransistor, being attached at a support plate 54 for shifting the toner deposit amount sensor 50 between the measurement position and the containment position. The support plate 55 is linked to a connection plate 55 with a pin 56, and the connection plate 55 is linked to the solenoid 53 with a connection pin 57. The connection plate 55 is rotatable on a fixed pin 58 as a fulcrum. The solenoid 53 is fixed to an attachment fixing plate 61 for attaching the toner deposit amount measuring device 50 at the image forming apparatus with fixing jigs 59 and 60. At the upper part of the toner deposit amount sensor 50, a cover plate 62 and an open-close plate 63 are provided, and the open-close plate 63 is linked to the solenoid 53 with two connection pins 64 and 65 and a connection plate 66, being rotatable on a fulcrum axis 68. On the back of the open-close plate 63, a correction plate 69 for correcting measurement characteristics of the toner deposit amount sensor 50 is provided.

In order to prevent the toner deposit amount sensor 50 from being contaminated by scattered toner usually generated in printing process, the toner deposit amount sensor 50 is stored in the container 51 by a spring provided in the solenoid 53 and a reset coil 70 and the container 51 is sealed up by making the open-close plate 63 contact to the cover plate 62, except the time when the toner deposit amount sensor 50 measures the deposit amount of the toner on the transfer drum 10. In the state that the container 51 is sealed up, the measurement characteristics of the toner deposit amount sensor 51 is corrected by using the correction plate 69 provided on the back of the open-close plate 63. By setting the interval between the correction plate 69 and the toner deposit amount sensor 50 equal to that between the transfer drum 10 and the sensor 50 in measuring the concentration of an toner image formed on the drum 10, the further correction step due to the difference between the interval from the sensor to the correction plate and that from the sensor to the drum can be removed and the measurement accuracy is more improved thereby. Then, the interval between the correction plate 69 and the toner deposit amount sensor 50 is preferably set as 1 mm–10 mm as the interval between the transfer drum 10 and the sensor 50.

After the measurement correction of the toner deposit amount sensor 50, the solenoid 53 is operated for executing the mode of measuring the reflectance of a toner image formed on the transfer drum 10. An axis of the solenoid 53 moves in the direction of an arrow [a] shown FIGS. 10, 11 and 12. By the motion of the axis, the open-close plate 63 rotates in the direction of an arrow [b] shown in FIG. 11 and the upper part of the toner deposit amount sensor 50 is opened. And the toner deposit amount sensor 50 is shifted in the direction of an arrow [c] shown in FIG. 12, linking to the motion of the connection plate 55 in the direction of an arrow [d] shown in FIG. 12, and set at the position where the sensor 50 measure the reflectance of a toner image. After the reflectance measurement of a toner image, the toner deposit among sensor 50 is again stored in the container 51 and the open-close plate 63 is closed, by the coil provided in the solenoid 53 and the reset coil 70 in stopping the force by the solenoid 53 for moving the axis in the direction to the measurement position.

Figure 13:
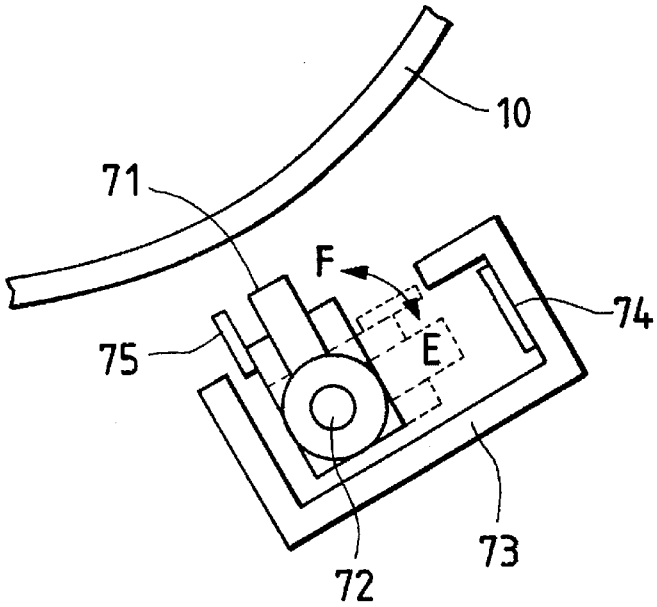
FIG. 13 is a drawing showing a structure of a toner deposit amount measuring device of another embodiment.
Figure 14:
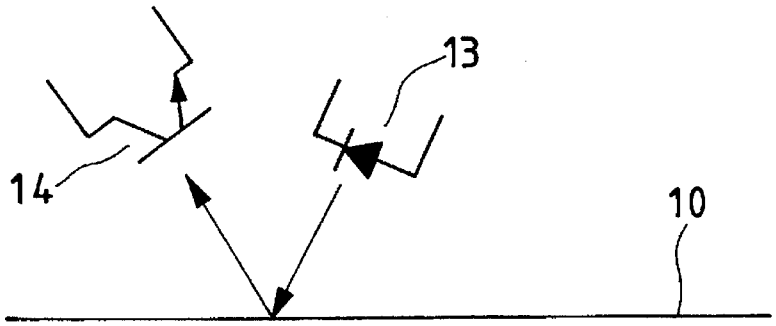
FIG. 14 shows a structure and an arrangement of a toner deposit amount sensor in a conventional technique.
Figure 15:
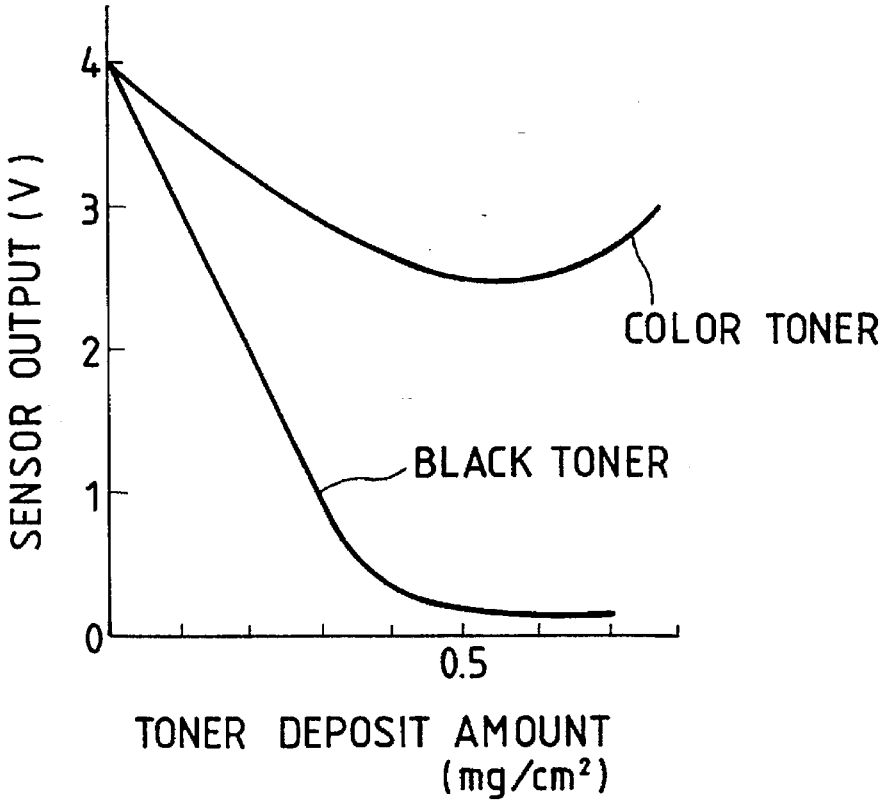
FIG. 15 shows a relation between sensor outputs and toner deposit amounts in a conventional technique.
Figure 16:
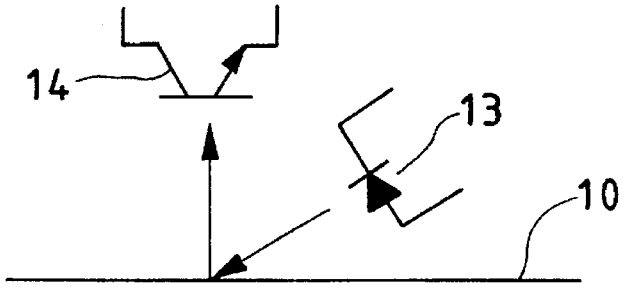
FIG. 16 shows a structure and an arrangement of a toner deposit amount sensor for measuring color toner deposit amount in a conventional technique.
Figure 17:
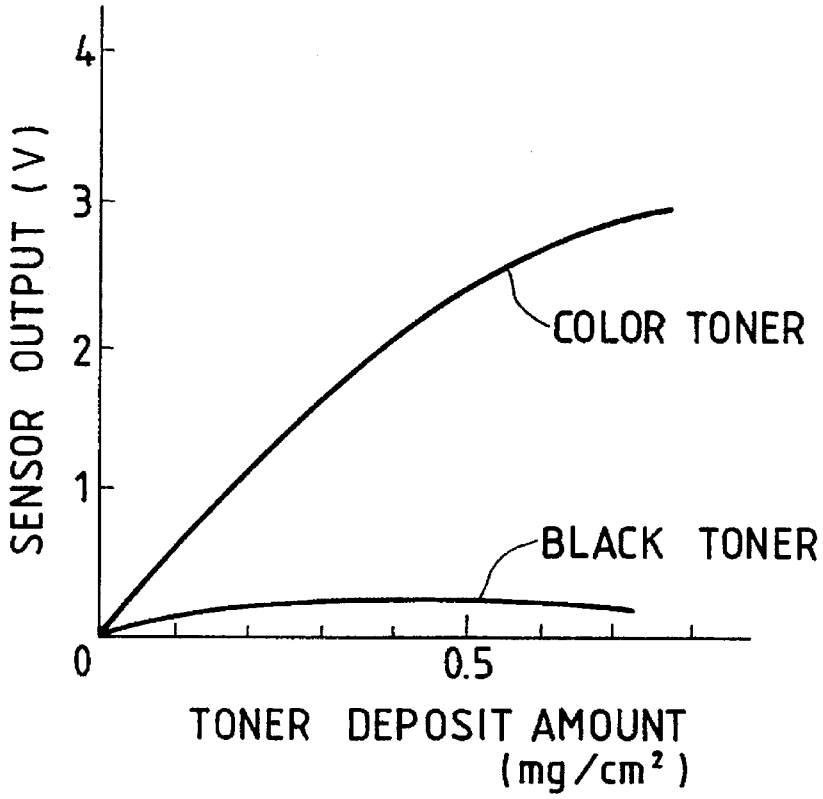
FIG. 17 shows a relation between sensor outputs and toner deposit amounts by the sensor shown by FIG. 16.

FIG. 13 is a picture showing a structure of a toner deposit amount measuring device 9 of another embodiment. This toner deposit amount measuring device 9 is also arranged at the same position opposite to the transfer drum 10 as the toner deposit measuring device 9 shown in FIG. 1. The toner deposit amount measuring device 9 is mainly composed of such a toner deposit amount sensor 71 as the sensor 50 shown by FIGS. 10–12, a rotation part 72 for rotating the sensor 71, and a container 73 for storing the sensor 71. In the container 73, a correction plate 74 for correcting the toner deposit amount sensor 71 is provided. And, at the shoulder of the toner deposit amount sensor 71, a cover plate 75 for obturating an opening of the container 73 is attached to prevent the scattered toner from entering the container 73 when the sensor 71 is stored in the container.

The toner deposit amount sensor 71 is rotatable on the axis of a rotation part 72 in the direction of an arrow F←→E and stored at the containment position E in case the image forming apparatus is in the states of stopping of the apparatus or ordinary printing operations. In the state of containing the toner deposit amount sensor 71, the measurement characteristics of the sensor 71 is corrected by using the correction plate 74 provided at the back of the container 73. In the embodiment also, by setting the interval between the correction plate 69 and the toner deposit amount sensor 71 equal to that between the transfer drum 10 and the sensor 71 in measuring the concentration of a toner image formed on the drum 10, the further correction step due to the difference between the interval from the sensor to the correction plate and that from the sensor to the drum can be removed and the measurement accuracy is as more improved as by the embodiment shown by FIGS. 10–12. Then, the interval between the correction plate 74 and the toner deposit amount sensor 71 is preferably set as 1 mm–10 mm as the interval between the transfer drum 10 and the sensor 71.

After the measurement correction of the toner deposit amount sensor 71, the image forming apparatus is operated for executing the mode of measuring the reflectance of a toner image formed on the transfer drum 10. In this mode, the toner deposit amount sensor 71 is rotated on the axis of the rotation part 72 by a rotation drive part not shown in a figure, and set at the measurement position F shown in FIG. 13 opposite to the transfer drum 10. After measuring the toner image concentration, the toner deposit amount sensor 71 is again rotated on the axis of the rotation part 72 by the rotation drive part and stored in the container 73.

Further, the toner deposit amount measuring device by the present invention is applicable to concentration measurement of a toner image formed on the surface of the photosensitive medium, a paper sheet and so on, not to mention the concentration measurement of a toner image formed on the transfer drum.

As explained above, by the image forming apparatus of the present invention, it comes possible certainly to measure the concentration measurement of a toner image formed on the base medium in the long period since the toner deposit amount sensor for measuring a toner image is stored in the container except the time of the concentration measurement, and the contamination of the sensor by the toner scattered in printing operations can be prevented. Further, it also comes possible accurately to correct the measurement characteristics and compensate the characteristics changes due to aging changes or environment temperature changes, of the toner deposit amount sensor since the correction of the sensor is executed by shielding the outside light and using the correction plate of invariable reflection characteristics. Furthermore, by setting the interval between the correction plate and the toner deposit amount sensor equal to that between the transfer drum 10 and the sensor in measuring the concentration of a toner image formed on the drum, the further correction step due to the difference between the interval from the sensor to the correction plate and that from the sensor to the drum can be removed and the measurement accuracy is more improved thereby. Then, the image forming apparatus capable of forming a certain and high quality of image can be realized since the image forming process can be controlled on the basis of the accurately measured toner deposit amount of an toner image.

What is claimed is:

1. An image forming apparatus by electro-photographic process using a plurality of colors of toner and black toner, having an image forming base medium for electrophotography, a measurement means for measuring deposit amounts of a plurality of colors of toner and black toner of images formed on said base medium and a control means for controlling a concentration of each toner image on the basis of said measured deposit amounts of said plurality of colors of toner and black toner, said apparatus being characterized in:

that said measurement means measures a deposit amount of at least one of said plurality of colors of toner and black toner, and said control means automatically adjusts at least one of image forming control parameters of a charging voltage, exposure strength, a development bias and transfer conditions, said adjusted image forming control parameters including said control parameters for ones of said plurality of colors of toner and black toner, whose deposit amounts are measured, and said control parameters for the other ones of said plurality of colors of toner and black toner, whose deposit amounts are not measured.

2. The image forming apparatus according to claim 1, wherein said measurement means measures a deposit amount of at least one of said plurality of colors of toner, and said control means estimates a deposit amount of black toner based on said measured deposit amount of at least one of said plurality of colors of toner.

3. The image forming apparatus according to claim 1, wherein said measurement means measures a deposit amount of black toner, and said control means estimates deposit amounts of said plurality of colors of toner based on said measured deposit amount of black toner.

4. The image forming apparatus according to claim 1, wherein said control means stores functions of representing correlations among said image forming control parameters for each one of said plurality of colors of toner and black toner, in advance.

5. The image forming apparatus according to claim 1, wherein said control means adjusts said image forming control parameters of all said plurality of colors of toner and black toner under conditions that a relation between each of said image forming control parameters for each one of said plurality of colors of toner and black toner and a deposit amount of said corresponding toner is the same on all said plurality of colors of toner and black toner.

6. The image forming apparatus according to claim 1, said apparatus having a printing mode of executing ordinary image forming and a test mode of executing adjustments of image forming control parameters by measuring said deposited amounts of toner.

7. The image forming apparatus according to claim 1, where an optical measurement means is provided in said measurement means, and said optical measurement means comprises a light-emitting element for irradiating deposited toner and a light-receiving element for sensing a strength of light reflected from said deposited toner, said light-receiving element having such a light-receiving face shape that said light-receiving element can receive both light regularly reflected from said deposited toner and at least a part of light irregularly reflected from said deposited toner.

8. An image forming apparatus by electro-photographic process using a plurality of colors of toner and black toner, having an image forming base medium for electro-photography, a measurement means for measuring deposit amounts of a plurality of colors of toner and black toner of images formed on said base medium and a control means for controlling a concentration of each toner image on the basis of said measured deposit amounts of said plurality of colors of toner and black toner, said apparatus being characterized in:

that said measurement means measures a deposit amount of at least one of said plurality of colors of toner and black toner, and said control means adjusts on demand at least one of image forming control parameters of a charging voltage, exposure strength, a development bias and transfer conditions, and values of said image forming control parameters to be adjusted are outputted to at least one of a display device and a memory unit of said control means, said adjusted image forming control parameters including said control parameters for ones of said plurality of colors of toner and black toner, whose deposit amounts are measured, and said control parameters for the other ones of said plurality of colors of toner and black toner, whose deposit amounts are not measured.

9. The image forming apparatus according to claim 8, wherein said measurement means measures a deposit amount of at least one of said plurality of colors of toner, and said control means estimates a deposit amount of black toner based on said measured deposit amount of at least one of said plurality of colors of toner.

10. The image forming apparatus according to claim 8, wherein said measurement means measures a deposit amount of black toner, and said control means estimates deposit amounts of said plurality of colors of toner based on said measured deposit amount of black toner.

11. The image forming apparatus according to claim 8, wherein said control means stores functions of representing correlations among said image forming control parameters for each one of said plurality of colors of toner and black toner, in advance.

12. The image forming apparatus according to claim 8, wherein said control means adjusts said image forming control parameters of all said plurality of colors of toner and black toner under conditions that a relation between each of said image forming control parameters for each one of said plurality of colors of toner and black toner and a deposit amount of said corresponding toner is the same on all said plurality of colors of toner and black toner.

13. The image forming apparatus according to claim 8, said apparatus having a printing mode of executing ordinary image forming and a test mode of executing adjustments of image forming control parameters by measuring said deposited amounts of toner.

14. The image forming apparatus according to claim 8, where an optical measurement means is provided in said measurement means, and said optical measurement means comprises a light-emitting element for irradiating deposited toner and a light-receiving element for sensing a strength of light reflected from said deposited toner, said light-receiving element having such a light-receiving face shape that said light-receiving element can receive both light regularly reflected from said deposited toner and at least a part of light irregularly reflected from said deposited toner.

15. An image forming apparatus by electro-photographic process using a plurality of colors of toner and black toner, having an image forming base medium for electro-photography, a measurement means for measuring deposit amounts of a plurality of colors of toner and black toner of images formed on said base medium and a control means for controlling a concentration of each toner image on the basis of said measured deposit amounts of said plurality of colors of toner and black toner, said apparatus being characterized in:

that said measurement means comprises a container with a cover plate for storing a toner deposit amount sensor therein, and a moving means for shifting said toner deposit amount sensor between a measurement position, said toner deposit amounts being measured at said measurement position, and a containment position, said toner deposit amount sensor being shifted to and stored in said container by closing said cover plate, and measurement characteristics of said toner deposit amount sensor being corrected by using a correction plate provided in said container, except the time of measuring said deposit amount of toner formed on said base medium.

16. The image forming apparatus according claim 15, wherein said correction plate is provided at a back of said cover plate of said container and said toner deposit amount sensor is arranged opposite to said correction plate in a state that said toner deposit amount sensor is stored in said container.

17. The image forming apparatus according claim 15, wherein an interval between said deposit amount sensor and said correction plate is equal to an interval between said deposit amount sensor and said base medium.

18. The image forming apparatus according to claim 15, where an optical measurement means is provided in said measurement means, and said optical measurement means comprises a light-emitting element for irradiating deposited toner and a light-receiving element for sensing a strength of light reflected from said deposited toner, said light-receiving element having of such a light-receiving face shape that said light-receiving element can receive both light regularly reflected from said deposited toner and at least a part of light irregularly reflected from said deposited toner.

19. The image forming apparatus according to claim 15, said apparatus having a printing mode of executing ordinary image forming and a test mode of executing adjustments of image forming control parameters by measuring said deposited amounts of toner.

* * * * *

UNITED STATES PATENT AND TRADEMARK OFFICE

CERTIFICATE OF CORRECTION

PATENT NO. : 5,625,857

DATED : April 29, 1997

INVENTOR(S) : Akira SHIMADA et al.

It is certified that error appears in the above-identified patent and that said Letters Patent is hereby corrected as shown below:

In the Abstract: Line 13, after "except" insert --during--.
Line 17, after "Furthermore," delete to end of line.
Line 18, delete entire line.
Line 19, delete "control parameters and".

| Column | Line | |
|---|---|---|
| 1 | 12 | After "superimposes" insert --the exposed-- |
| 1 | 13 | Delete "the exposed image". |
| 1 | 28 | Change "decrease" to --decreased--. |
| 1 | 47 | Change "to" to --of--. |
| 1 | 61 | Change "is" to --are--. |
| 2 | 15 | Change "Accuracy" to --accuracy--. |

UNITED STATES PATENT AND TRADEMARK OFFICE

CERTIFICATE OF CORRECTION

PATENT NO. : 5.625,857

DATED : April 29, 1997

INVENTOR(S) : Akira SHIMADA et al.

It is certified that error appears in the above-identified patent and that said Letters Patent is hereby corrected as shown below:

| Column | Line | |
|---|---|---|
| 3 | 63 | Change "in" to --for--. |
| 3 | 65 | After "except" insert --during--. |
| 4 | 18 | Change "typycally showing" to --showing typical--. |
| 4 | 57 | Change "is" to --are--. |
| 4 | 62 | After "belt" insert --of--. |
| 4 | 64 | Before "a base" insert --as--. |
| 5 | 5 | After "referred to" insert --as--. |
| 5 | 52 | Before "erased" insert --is--. |
| 5 | 62 | After "part" insert --of--. |
| 6 | 27 | Change "a" to --an--. |
| 6 | 44 | After "effects" insert --caused--. |

UNITED STATES PATENT AND TRADEMARK OFFICE

CERTIFICATE OF CORRECTION

PATENT NO. : 5,625,857

DATED : April 29, 1997

INVENTOR(S) : Akira SHIMADA et al.

It is certified that error appears in the above-identified patent and that said Letters Patent is hereby corrected as shown below:

| Column | Line | |
|---|---|---|
| 6 | 46 | Change "merit" to --advantage--. |
| 6 | 53 | Change "typically showing" to --showing typical--. |
| 7 | 41 | Change "the enough" to --a sufficient--. |
| 7 | 52 | After "other," insert --corresponding--. |
| 7 | 62 | Change "mirror" to --complete--. |
| 7 | 63 | Change "reflection on" to --reflectance of--. |
| 8 | 10 | After "makes" delete "it". |
| 9 | 26 | Change "is" to --are--. |
| 9 | 41 | After "such" delete "the". |
| 9 | 42 | Change "hardly" to --insufficiently--. |

UNITED STATES PATENT AND TRADEMARK OFFICE

CERTIFICATE OF CORRECTION

PATENT NO. : 5,625,857

DATED : April 29, 1997

INVENTOR(S) : Akira SHIMADA et al.

It is certified that error appears in the above-identified patent and that said Letters Patent is hereby corrected as shown below:

| Column | Line | |
|---|---|---|
| 9 | 57 | After "apparatus" insert --operation--. |
| 10 | 17 | Change "hardly" to --subject to insufficient measurement--. |
| 10 | 29 | Change "storing" to --stored--. |
| 10 | 54 | After "70" insert --,--. |
| 10 | 56 | After "excet" insert --during--. |
| 10 | 65 | Change "an" to --a--. |
| 11 | 17 | Change "measure" to --measures--. |
| 11 | 19 | Change "among" to --amount--. |
| 11 | 52 | Change "more" to --much--. |
| 12 | 8 | Change "comes possible certainly to measure" to --becomes possible to measure with certainty--. |

UNITED STATES PATENT AND TRADEMARK OFFICE

CERTIFICATE OF CORRECTION

PATENT NO. : 5,625,857

DATED : April 29, 1997

INVENTOR(S) : Akira SHIMADA et al.

It is certified that error appears in the above-identified patent and that said Letters Patent is hereby corrected as shown below:

| Column | Line | |
|---|---|---|
| 12 | 9 | After "medium" change "in" to --for--. |
| 12 | 11 | After "except" insert --during--. |
| 12 | 14 | Change "accurately to" to --to accurately-- |
| 12 | 31 | Change "an" to --a--. |
| 13 | 16 | Change "where" to --wherein--. |
| 14 | 11 | Change "where" to --wherein--. |
| 14 | 52 | Change "where" to --wherein--. |
| 14 | 57 | After "having" delete "of". |

Signed and Sealed this

Second Day of December, 1997

Bruce Lehman

*Attest:*

BRUCE LEHMAN

*Attesting Officer*

*Commissioner of Patents and Trademarks*